US006254226B1

(12) United States Patent
Lengyel et al.

(10) Patent No.: US 6,254,226 B1
(45) Date of Patent: Jul. 3, 2001

(54) LIQUID INK CARTRIDGE WITH RECESSED FILL HOLE AND INK TANK VENT

(75) Inventors: Dennis M. Lengyel, Hemlock; Hiep H. Nguyen, Rochester, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/616,383

(22) Filed: Jul. 14, 2000

(51) Int. Cl.[7] ..... B41J 2/175
(52) U.S. Cl. ..... 347/86
(58) Field of Search ..... 347/84, 85, 86, 347/87; 53/474

(56) References Cited

U.S. PATENT DOCUMENTS

| | | | | |
|---|---|---|---|---|
| 5,289,212 | | 2/1994 | Carlotta | 347/86 |
| 5,875,615 | * | 3/1999 | Ito et al. | 53/474 |
| 5,953,030 | * | 7/1999 | Ishinaga et al. | 347/86 |
| 5,997,121 | | 12/1999 | Altfather et al. | 347/7 |

FOREIGN PATENT DOCUMENTS 06226390 4/1996 (JP) .

* cited by examiner

*Primary Examiner*—N. Le
*Assistant Examiner*—Anh T. W. Vo
(74) *Attorney, Agent, or Firm*—David J. Arthur

(57) ABSTRACT

A fluid cartridge, such as a cartridge for filling with ink for use in ink jet printhead includes a wick chamber that has outer walls, including a top wall, and an ink chamber formed of a plurality of outer walls. A fluid conduit connects the ink chamber and the wick chamber. The outer walls of the ink chamber are formed to provide no fluid communication between the ink chamber and the ambient environment, except through the fluid conduit and the wick chamber. A vent opening through the top wall of the wick chamber provides communication between the wick chamber and the ambient environment, and an outlet opening through an outer wall other than the top wall of the wick chamber provides fluid communication for the ink to flow from the wick chamber. A vent tube extends from the vent opening into the interior of the wick chamber, and projections extend from the top wall of the wick chamber into the interior of the wick chamber, farther than does the vent tube.

7 Claims, 2 Drawing Sheets

LIQUID INK CARTRIDGE WITH RECESSED FILL HOLE AND INK TANK VENT

BACKGROUND OF THE INVENTION

The present invention relates to ink cartridges used for supplying liquid ink to a printhead in a thermal ink jet printing apparatus. Specifically, the present invention relates to structure and methods for filling and venting the ink tank of an ink supply cartridge in a thermal ink jet printing apparatus.

Thermal ink jet printing is well understood in the art. U.S. Pat. No. 5,997,121 describes several aspects of such printing.

In existing thermal ink jet printing, the printhead comprises one or more ink filled channels communicating with a relatively small supply chamber, or manifold, at one end, and having an opening at the opposite end, referred to as a nozzle. In current practical embodiments of drop on demand thermal ink jet printers, it has been found that the printers work most effectively when the pressure of the ink in the printhead nozzle is kept within a predetermined range of gauge pressures. Specifically, at those times during operation in which an individual nozzle or an entire printhead is not actively emitting a droplet of ink, it is important that a certain negative pressure, or "back pressure", exist in each of the nozzles and, by extension, within the ink supply manifold of the printhead. The attributes of creating and maintaining such back pressure are described in the U.S. Pat. No. 5,289,212, the contents of which are incorporated herein by reference.

The ink is supplied to the printhead from an ink cartridge. The ink cartridge contains a supply of ink, and is typically configured to maintain the required negative pressure. The ink cartridge is typically a user-replaceable unit that mates with the printhead of the printing apparatus.

Before delivery to the user, the ink cartridge is filled with ink. Changes in the ambient environmental conditions (i.e., temperature, atmospheric pressure, etc.) after the cartridge is filled can cause challenges for the user. If the cartridge is completely sealed, the contents of the cartridge may be at a higher pressure than the ambient when the user unseals the cartridge to install it in the printhead. In that instance, ink may be forcefully and unpredictably ejected from the cartridge when the cartridge is unsealed.

SUMMARY OF THE INVENTION

A fluid cartridge, such as a cartridge for filling with ink for use in an ink jet printhead, comprises a wick chamber having outer walls, and an ink chamber, also having outer walls. An outlet opening extends through an outer wall of the wick chamber. A vent opening extends through an outer wall of the wick chamber. A fluid conduit connects the ink chamber and wick chamber. The outer walls of the ink chamber are formed to provide no fluid communication between the ink chamber and the ambient environment, except through the fluid conduit and the wick chamber.

In accordance with another aspect of the present invention, a method of filling a cartridge is provided. The cartridge comprises a housing defining a wick chamber and an ink chamber with a fluid conduit between the ink chamber and the wick chamber. The housing additionally contains wick material in the wick chamber, and has a fluid opening through the housing into the wick chamber. In accordance with the method of the present invention, an air gap is maintained between the fluid opening and the wick material, and ink is supplied through the fluid opening into the wick chamber until the ink flows through the fluid conduit into the ink chamber. The step of maintaining a gap between the fill tube fluid opening and the wick material comprises providing structure that prevents the wick material from contacting the fluid opening.

DETAILED DESCRIPTION OF A PREFERRED EMBODIMENT

Figure 1:
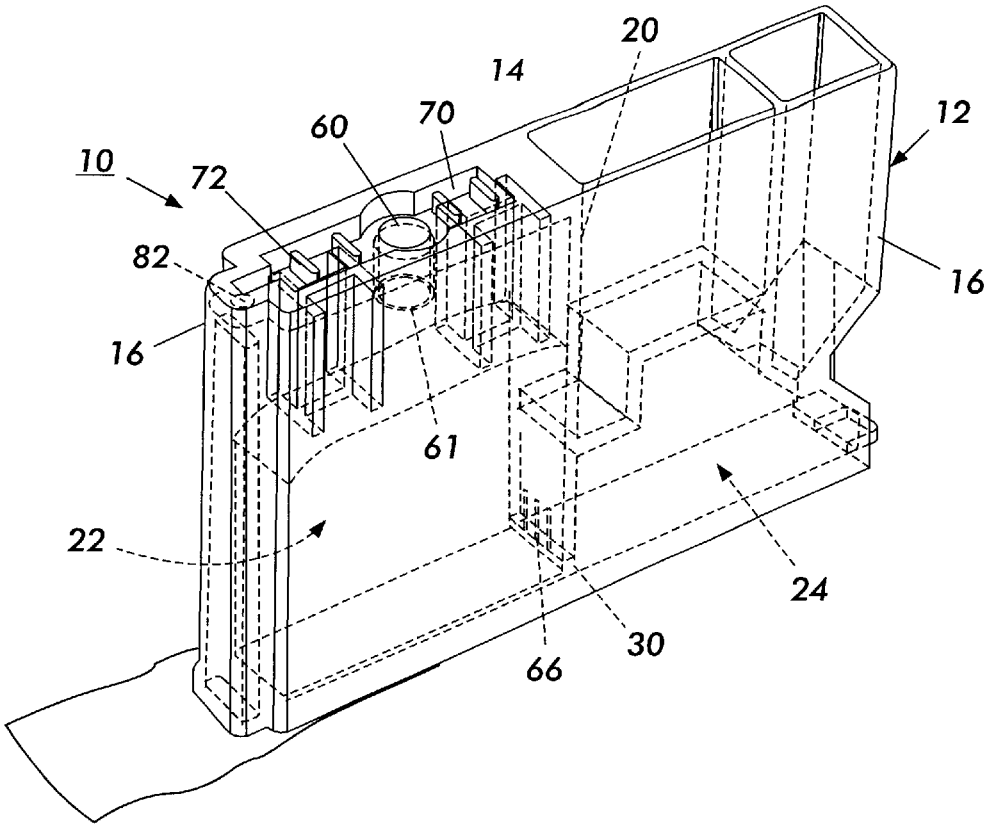
FIG. 1 is a perspective view of an exemplary ink tank incorporating a particular embodiment of the structure of the present invention showing the eternal structure thereof in phantom.
Figure 2:
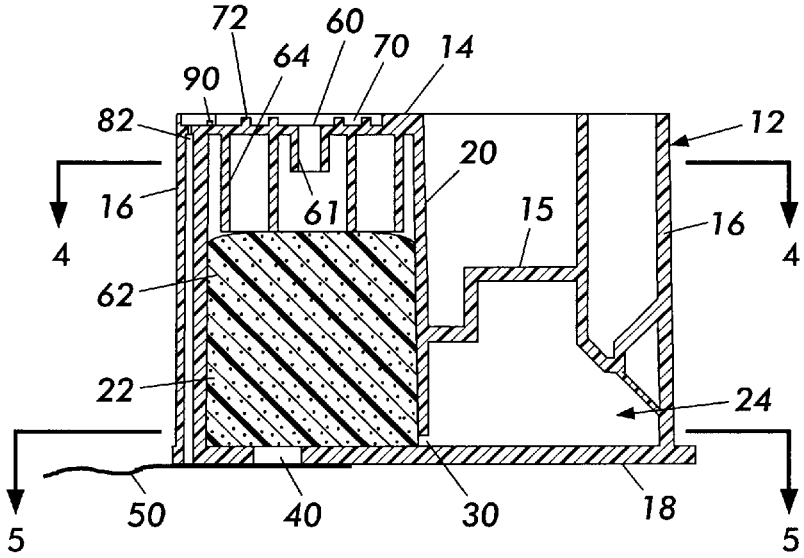
FIG. 2 is a side cross-sectional view of an ink cartridge incorporating the present invention.

Referring to FIGS. 1 and 2, a fluid cartridge 10 incorporating the present invention includes a housing 12 formed of a plurality of walls 14, 15, 16, 18. In the particular embodiment illustrated, the walls of the housing include a top wall 14, 15 and a substantially parallel and opposed bottom wall 18. Four side walls 16 complete the housing. As will be recognized by those skilled in the art, the top wall 14 and side walls 16 of the housing maybe integrally formed of a single molded piece of plastic as a single unit, and the bottom wall 18 maybe glued onto the structure. The walls thus enclose a substantially hollow housing interior. In FIG. 1, the internal structure of the cartridge is shown in phantom lines. FIG. 2 is a side view in cross section.

The interior of the housing contains a wick chamber 22 and a fluid or ink chamber 24. A divider 20 extends from the top wall 14 toward the bottom wall 18, and also extends between two opposing side walls 16, to divide the hollow housing interior into the wick chamber and the fluid or ink chamber.

A fluid conduit 30 provides fluid communication between the ink chamber and the wick chamber. In the embodiment particularly described and shown, the fluid conduit between the wick chamber and the ink chamber is a gap in the divider 20, adjacent the bottom wall 18 of the housing. However, those skilled in the art will recognize that other types of fluid conduit (such as a tube or other structure) between the ink chamber 24 and the wick chamber 22 may be provided. The fluid conduit between the ink chamber and the wick chamber should be close to the bottom of the ink chamber.

Figure 6:
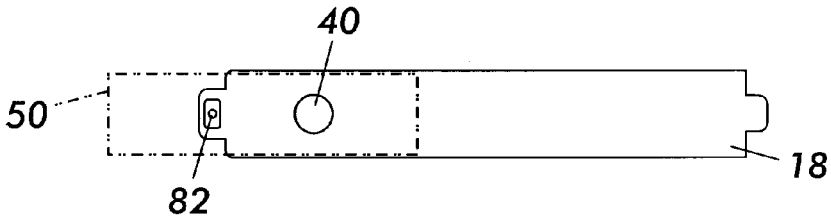
FIG. 6 is a bottom view of an ink cartridge incorporating the present invention.

An outlet opening 40 is formed through one of the walls forming the housing for the wick chamber. The outlet opening 40 provides the point at which the cartridge interacts with the printhead, and through which ink is supplied from the cartridge to the ink jet printhead. Referring to FIG. 6, the outlet opening 40 is shown in the bottom wall 18 of the wick chamber, which is substantially opposed to the top wall. However, the outlet opening may also be provided through one of the side walls of the housing. A seal 50 covers the outlet opening 40 prior to the time at which the cartridge is installed in the printhead of the printing apparatus. For example, metallic tape, foil, or other material that the ink cannot penetrate is placed on the outer surface of the wall having the outlet opening to cover the outlet opening, and sealed to the outer surface of the bottom wall. The seal 50 is removable, so that the user can remove it before inserting the cartridge into the printhead. An extended end of the seal 50 extends beyond the end of the bottom wall 18. The user can grasp this extended end to remove the tape from the bottom wall 18 when the user is ready to install the cartridge in the printhead. However, in certain configurations, the seal may remain in place, and be punctured or otherwise penetrated by the printhead when the cartridge is installed for use in the printing apparatus.

An ink retaining member, such as a wick 62 substantially fills the interior of the wick chamber 22. The wick material is well understood by those familiar with the art. For example, polyether foam material may be used as the wick 62. When saturated with liquid (such as ink), the wick material facilitates maintaining the negative pressure for proper operation of the printhead. Therefore, the specific material may be different for different print apparatus configurations.

The ink chamber 24 is substantially free of ink retaining material. Liquid ink, stored in the ink chamber 24, is transferred from the ink chamber to the wick 62 through the fluid conduit 30. The ink is released through the outlet opening 40 as necessary to supply the printhead with ink for printing.

Extending from the fluid conduit opening 30 upward along the wick chamber side of the divider 20 are vertical grooves 66. These vertical grooves may be approximately ⅜ inch (1.0 cm) in length. The grooves assist in conducting ink from the ink chamber into the wick material in the wick chamber.

A combination fill hole and vent opening 60 extends through one of the outer walls of the wick chamber. In the illustrated embodiment, the fill hole/vent opening 60 extends through the top wall 14 of the wick chamber. Surrounding the vent opening 60 and extending into the wick chamber 22 is a vent tube 61.

Projections, such as ribs 64, extend vertically from the top wall of the housing into the wick chamber 22. The ribs 64 extend farther into the wick chamber than does the vent tube 61. For example, the ribs may extend into the interior of the wick chamber two or three times as far as the vent tube. Thus, the vent tube may extend 0.10 in (0.25 cm) into the wick chamber, and the ribs extend 0.20 in (0.50 cm). In another configuration, the vent tube may extend 0.20 in (0.50 cm) into the wick chamber, and the ribs extend 0.40 in (1.0 cm).

Figure 4:
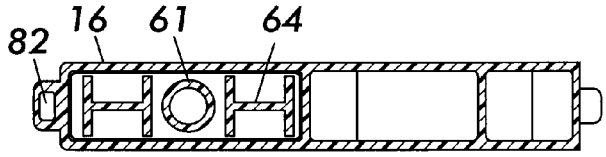
FIG. 4 is a cross-sectional view of an ink cartridge incorporating the present invention, taken along line 4—4 of FIG. 2.
Figure 5:
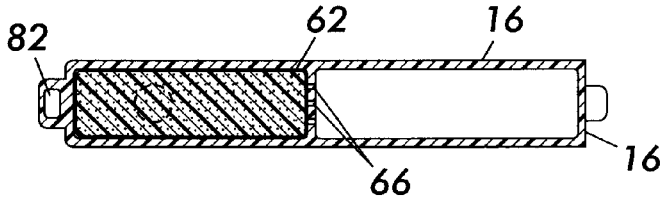
FIG. 5 is a cross-sectional view of an ink cartridge incorporating the present invention, taken along line 5—5 of FIG. 2.

In accordance with a particular embodiment, the ribs 64 are H shape in cross section, as seen most clearly in FIG. 4. However, after reading the present description, those skilled in the art will recognize that numerous other shapes may be used. Among the other shapes possible are (referring to their cross-sectional shape) Z, I, curved, and other shapes.

The ribs 64 maintain an air gap between the top of the wick material 62 and the lower edge of the fill tube or vent tube 61, so that the wick material does not come into contact with the vent tube. The ribs 64 extending from the top wall of the wick chamber housing prevent the wick material from contacting the vent tube.

The housing walls forming the fluid or ink chamber are integrally formed or sealed so that there is no fluid communication between the fluid chamber and the ambient environment, except through the fluid conduit and the wick chamber. In the preferred embodiment, the top and side walls 15, 16 of the ink chamber portion 24 of the housing are integrally formed with no openings. The top and side walls may be molded of a plastic material such as polypropylene using injection molding techniques. However, those skilled in the art will recognize that other materials and manufacturing techniques may be used to form the housing.

A bottom wall 18 that is solid across the ink chamber portion of the housing is securely sealed to the bottom edge of the side walls 16 of the housing. However, depending on the volume desired for the ink chamber, the walls of the ink chamber may be formed in other manners. For example, a horizontal top wall 15 for the ink chamber may be molded between the sidewalls at a point lower than the top wall 14 of the wick chamber. The top wall of the ink chamber so formed need not be horizontal, nor flat, and may include steps or other shapes.

Figure 3:
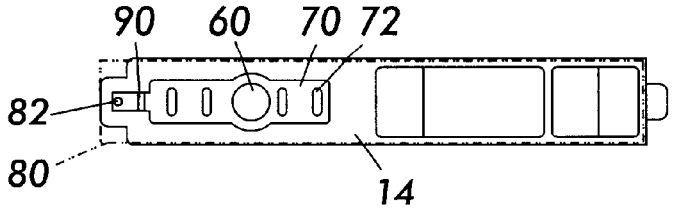
FIG. 3 is a top view of an ink cartridge incorporating the present invention.

In accordance with a particular embodiment of the cartridge incorporating the present invention, the top wall 14 of the wick chamber includes a recessed portion 70 surrounding the vent opening 60, as seen in FIG. 3. The recess 70 in the outer surface of the top wall 14 is in fluid communication with an overflow conduit 82. In the particular embodiment illustrated, the overflow conduit comprises a tube integrally formed along one side wall of the housing, with one end of the overflow tube 82 at the recess 70, and the other end near the cartridge outlet opening 40. Detailed descriptions of particular embodiments of the recess 70 and of the overflow tube 82 are contained in the copending U.S. patent applications, INK CARTRIDGE WITH SPILLOVER DAM, naming inventors Eric Merz and Hiep Nguyen, Serial No. 09/616,860 and INK CARTRIDGE WITH OVERFLOW CONDUIT, naming inventors Edward Carrese, Dennis Lengyel, Eric Merz and Hiep Nguyen, Serial No. 09/616,572, both filed on Jul. 14, 2000, and assigned to the same assignee as the assignee of the present application, which applications are hereby incorporated by reference.

A seal 80 such as metallic tape, foil, or other material that is impervious to the liquid ink covers the recess 70 in the top wall of the housing.

The tape 80 is bonded to the raised (non-recessed) portions of the outer surface of the top wall 14, so that the tape does not seal or close off the vent opening 60. Because of the recess in the top wall that is in communication with the overflow tube, the vent opening 60 continues to provide atmospheric or fluid communication between the wick chamber and the ambient environment. However, the projections or ribs prevent the wick material from contacting the vent tube.

In accordance with an aspect of the present invention, a fluid cartridge as described above can be filled through the vent opening 60 provided in the wick chamber. A fill nozzle (not shown) may be applied to the vent opening through the top wall of the wick chamber, and ink directed from the fill nozzle into the wick chamber 22. The wick material 62 absorbs the ink, until the wick material is substantially saturated. Once the wick material is saturated, additional ink added to the wick chamber begins to flow through the fluid conduit 30 into the ink chamber 24. The filling process is continued, until the ink chamber 24 is substantially full with free ink. The flow of ink into the wick chamber is then turned off.

Prior to filling with ink, the ink chamber 24 and wick chamber 22 are substantially evacuated of air or other gases, so that they contain a vacuum. However, as those familiar with the art will recognize, it is often impractical to obtain a perfect vacuum in a mass manufacturing operation. Therefore, it is almost inevitable that a small amount of air will remain in the ink chamber 24, forming a bubble as the ink chamber fills with ink, and preventing the ink from completing filling the ink chamber.

Using a single vent opening 60 for both filling the cartridge with ink, and for venting, eliminates the need for a plug to fill a fill hole directly into the ink chamber. The vent tube 61 provides additional structural rigidity to the top wall portion 14 of the housing around the vent opening 60. The additional rigidity improves the ability of the top wall of the housing to withstand pressure applied when the fill nozzle is applied to the vent opening to supply ink to the cartridge.

The tape seal 80 is then applied over the top wall of the housing. Because of the recess in the top wall that is in communication with the overflow tube, the vent opening continues to provide atmospheric or fluid communication between the wick chamber and the ambient environment. However, the projections or ribs 64 continue to prevent the wick material 62 from contacting the vent tube 61. Therefore, ink is not siphoned out of the wick chamber through the vent opening.

The seal 50 over the outlet opening 40 also seals the overflow tube 82. While the seals 50, 80 block fluid exchange between the interior and exterior of the cartridge, changes in the external environmental conditions change the relative pressures between the interior and exterior of the cartridge. These changes are principally due to the air bubble in the ink chamber 24. For example, if the cartridge is heated, the air bubble will try to expand, increasing the relative pressure inside the cartridge. Also, placing the cartridge in an environment with a lower atmospheric pressure (such as by taking the cartridge to a high elevation) will cause the interior of the cartridge to have a higher pressure relative to the exterior.

If the fluid conduit to the vent opening is opened (such as by removing the seal 50 from the overflow tube 82) when the internal pressure is higher than the external pressure, the air inside the chamber (particularly the air bubble in the ink chamber) expands, pushing additional ink back into the wick material. The gap between the top of the wick material and the vent tube ensures that ink is not siphoned through the vent tube and vent opening. If the wick material is fully saturated, some of the ink pushed into the wick chamber may rise into the air gap between the top of the wick material and the bottom of the vent tube 61. In the unlikely event that sufficient ink fills the gap as to contact the bottom of the vent tube 61, or otherwise comes into contact with the vent opening 60, the ink may flow out through the vent opening, into the recess in the outer surface of the top wall of the wick chamber. If sufficient ink is present, the overflow may flow down the overflow tube. However, the ribs 64 maintain a sufficient air gap between the top of the wick material 62 and the end of the vent tube 61 so as to substantially ensure that such overflow of liquid ink does not occur during expected atmospheric changes of shipment.

The structure described above reduces the sudden ejection or squirting of ink when the seal 50 is removed, if the vent has been sealed and environmental changes have occurred to create a significant pressure differential between the interior and exterior of the housing. If the external pressure is significantly less than the internal pressure, the increased pressure in the overflow tube 82 and the air gap between the vent tube 61 and the wick material 62 will prevent the ink from entering the gap, the recess in the top wall, or the overflow tube. When the tape seal 50 covering the outlet of the overflow tube 82 and the outlet opening 40 from the wick chamber is removed, the overflow tube 82 is opened first, before the outlet opening. The air in the overflow tube 82, the recess 70, and the gap in the wick chamber will escape first, before allowing ink to begin to fill the gap and perhaps flow into the recess (if the pressure differential is sufficient). In rare cases, sufficient ink may reach the overflow tube.

A specific embodiment of the present invention has been described. Those skilled in the art after reading the above description will identify various modifications that can be made to the embodiment described above without departing from the spirit of the invention. For example, other shapes of ink cartridges may incorporate the invention. Also, other shapes may be incorporated into the projections, or other structures may be used. In addition, the vent opening, the outlet opening, and other elements may be placed in different locations. Therefore, the above description is illustrative, and the scope of the invention is not to be limited to the embodiment described above.

What is claimed:

1. A fluid cartridge for supplying fluid on demand, the cartridge comprising:

a wick chamber having a plurality of outer walls defining an interior;

an outlet opening through an outer wall of the wick chamber;

a vent opening through an outer wall of the wick chamber;

a vent tube extending from the vent opening into the interior of the wick chamber;

structure adjacent the vent tube extending into the interior of the wick chamber, wherein the structure adjacent the vent tube extends further into the interior of the wick chamber than does the vent tube;

a fluid chamber having a plurality of outer walls; and a fluid conduit between the fluid chamber and the wick chamber;

wherein the outer walls of the fluid chamber are formed to provide no fluid communication with the fluid chamber except through the wick chamber.

2. The cartridge of claim 1, additionally comprising wick material in the wick chamber.

3. The cartridge of claim 2, additionally comprising a vent tube extending from the vent opening into the interior of the wick chamber, and wherein the structure adjacent the vent opening extends farther into the interior of the wick chamber than does the vent tube.

4. The cartridge of claim 1, wherein the vent opening is above the outlet opening and above the fluid conduit between the ink chamber and the wick chamber.

5. The cartridge of claim 4, wherein:

one of the outer walls of the wick chamber is a top wall; and the vent opening is through the top wall of the wick chamber.

6. The cartridge of claim 5, additionally comprising:

a vent tube extending from the vent opening into the interior of the wick chamber; and projections extending from the top wall of the wick chamber into the interior of the wick chamber, wherein the projections extend farther into the wick chamber than does the vent tube.

7. A cartridge for supplying ink on demand to an ink-jet printhead, the cartridge comprising:

a housing having a top wall, a bottom wall, and a plurality of side walls all defining a substantially hollow housing interior, wherein the housing additionally comprises a divider extending from the top wall toward the bottom wall, and extending between two of the side walls to divide the hollow housing interior into a wick chamber and an ink chamber;

a fluid conduit between the wick chamber and the ink chamber; wick material in the wick chamber;

a vent opening through the top wall of the housing into the wick chamber;

a vent tube extending from the vent opening into the wick chamber portion of the housing interior;

ribs extending vertically from the top wall of the housing into the wick chamber portion of the housing interior, wherein the ribs extend farther into the wick chamber portion of the housing interior than does the vent tube opening to prevent the wick material from contacting the vent tube; and an outlet opening through a wall of the wick chamber portion of the housing, wherein the outer walls of the ink chamber portion of the housing are formed to provide no fluid communication between the interior of the ink chamber and the ambient environment except through the wick chamber.

* * * * *